US007341475B2

(12) United States Patent
Rivers

(10) Patent No.: US 7,341,475 B2
(45) Date of Patent: Mar. 11, 2008

(54) GROUND ROD CAP

(75) Inventor: Paul Brent Rivers, Cullman, AL (US)

(73) Assignee: AT & T Delaware Intellectual Property, Inc., Wilmington, DE (US)

( * ) Notice: Subject to any disclaimer, the term of this patent is extended or adjusted under 35 U.S.C. 154(b) by 432 days.

(21) Appl. No.: 10/752,920

(22) Filed: Jan. 7, 2004

(65) Prior Publication Data

US 2005/0145286 A1 Jul. 7, 2005

(51) Int. Cl.
*H01R 13/56* (2006.01)

(52) U.S. Cl. ..... 439/445; 138/96 R; 439/100; 439/901

(58) Field of Classification Search ..... 138/96 R, 138/96 T; 439/893, 901, 100, 445
See application file for complete search history.

(56) References Cited

U.S. PATENT DOCUMENTS 1,556,966 A * 10/1925 Selig ..... 16/441
1,661,712 A * 3/1928 Van Wagner ..... 403/209
2,147,829 A * 2/1939 Daniels ..... 173/126
2,328,415 A * 8/1943 Birkenmaier ..... 439/100
3,435,124 A * 3/1969 Channell ..... 174/38
4,156,793 A * 5/1979 Carlson ..... 174/7
4,202,378 A * 5/1980 Bush et al. ..... 138/96 R
5,381,636 A * 1/1995 Kassardjian et al. ..... 52/301
D371,944 S 7/1996 Spirer
5,568,708 A * 10/1996 Kassardjian et al. ..... 52/301
5,672,065 A * 9/1997 Womack ..... 439/100
5,864,093 A * 1/1999 Hecock et al. ..... 174/78
6,137,049 A * 10/2000 Hecock ..... 174/7
6,959,457 B2 * 11/2005 Hernandez ..... 4/218
6,978,803 B2 * 12/2005 Brown et al. ..... 138/96 R
2004/0154812 A1 * 8/2004 McDonald ..... 173/90
2005/0189129 A1 * 9/2005 Rivers et al. ..... 173/90

* cited by examiner

*Primary Examiner*—James Hook
(74) *Attorney, Agent, or Firm*—Lee & Hayes, PLLC

(57) ABSTRACT

A ground rod cap is disclosed. The ground rod cap includes a crown portion and a support portion connected to the crown portion. The crown portion is configured to receive a ground rod.

14 Claims, 4 Drawing Sheets

GROUND ROD CAP

BACKGROUND

The present application is related, generally and in various embodiments, to a ground rod cap. In the telecommunication and other industries, a ground rod is often used to establish a reference voltage and to protect various devices from damage due to lightning or static electricity. In many instances, the ground rod is driven into the earth until only a relatively small length of the ground rod remains above the earth. A ground rod clamp is then connected to the portion of the rod that remains above the earth. Finally, a ground wire connected to a device and/or system is connected to the ground rod clamp, thereby electrically connecting the ground rod to the device and/or system.

Such ground rods can be found at a significant number of residences. When an object falls onto a ground rod, the ground rod is very unforgiving and the object may be damaged. Also, exposure to the elements often causes the portion of the rod that remains above the earth to rust and turn brown, thereby making the rod more difficult to see.

SUMMARY

In one general respect, this application discloses embodiments of a ground rod cap. According to various embodiments, the ground rod cap includes a crown portion and a support portion connected to the crown portion. The crown portion is configured to receive a ground rod.

According to other embodiments, the ground rod cap includes a closed end and an open end opposite the closed end. The ground rod cap defines a void that encircles a cavity configured to receive a ground rod.

Other embodiments of the disclosed invention will be or become apparent to one skilled in the art upon review of the following drawings and detailed description. It is intended that all such additional embodiments be included within this description, be within the scope of the disclosed invention, and be protected by the accompanying claims.

DETAILED DESCRIPTION

Figure 1:
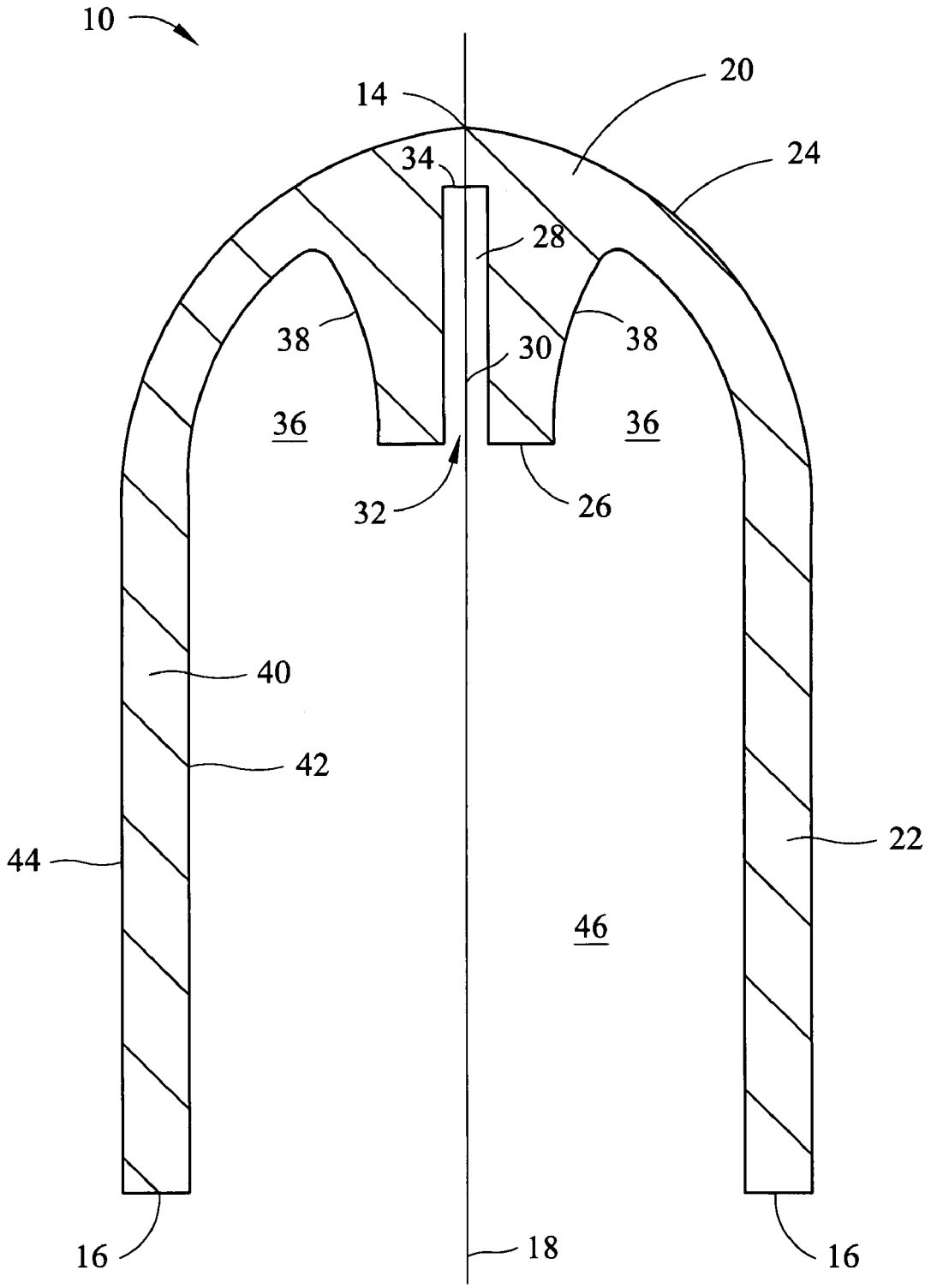
FIG. 1 illustrates various embodiments of a ground rod cap.
Figure 2:
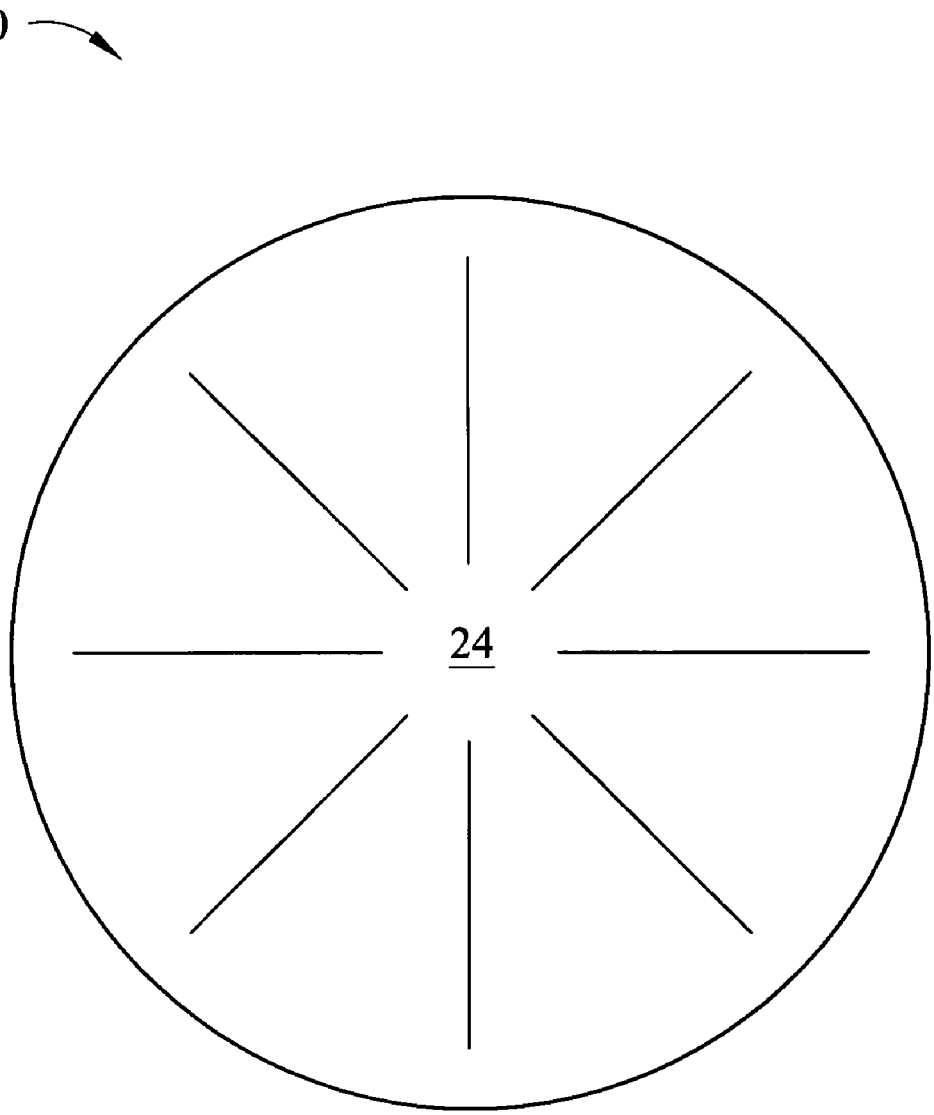
FIG. 2 is a top view of the ground rod cap of FIG. 1 according to various embodiments.
Figure 3:
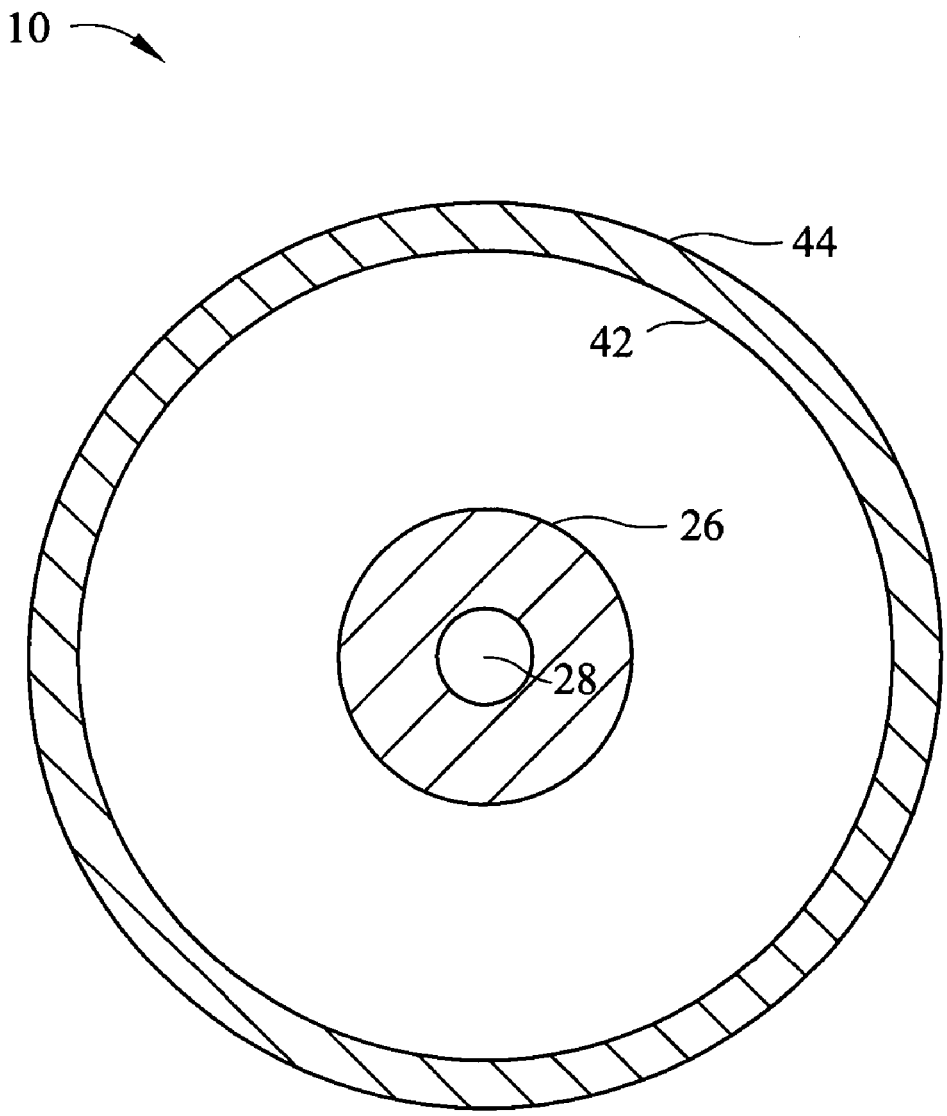
FIG. 3 is a bottom view of the ground rod cap of FIG. 1 according to various embodiments.

FIGS. 1-3 illustrate various embodiments of a ground rod cap 10. The ground rod cap 10 is configured to cover an exposed portion of a ground rod 12 (shown in FIG. 4) and includes a first end 14 and a second end 16 opposite the first end 14. The first end 14 is a closed end and the second end 16 is an open end. The ground rod cap 10 defines a first axis 18 and includes a crown portion 20 and a support portion 22 connected to the crown portion 20.

The crown portion 20 of the ground rod cap 10 is configured to receive the ground rod 12 and includes a first surface 24 and a second surface 26. The first surface 24 is an outer surface and the second surface 26 is a bottom surface. The outer surface 24 of the crown portion 20 is curved and defines a dome. The bottom surface 26 of the crown portion 20 defines a cavity 28 that is configured to receive the ground rod 12. The cavity 28 is cylindrically-shaped, has a first diameter and a first maximum depth associated therewith, and defines a second axis 30. The second axis 30 is coincident with the first axis 18. The cavity 28 includes a first end 32 proximate the bottom surface 26 of the crown portion 20 and a second end 34 opposite the first end 32. The first end 32 of the cavity 28 is an open end and the second end 34 of the cavity 28 is a closed end. The second end 34 of the cavity 28 is positioned away from the outer surface 24 of the crown portion 20 by a distance greater than or equal to the first diameter associated with the cavity 28.

The bottom surface 26 of the crown portion 20 also defines a void 36 that encircles a portion of the cavity 28. The void 36 is bounded by a curved surface 38. The void 36 has a second maximum depth associated therewith, and the first maximum depth associated with the cavity 28 is greater than the second maximum depth.

The support portion 22 of the ground rod cover 10 includes a curved wall 40 having an inner surface 42 and an outer surface 44. The curved wall 40 of the support portion 22 is a continuously curving wall that has a uniform thickness. The support portion 22 is cylindrically-shaped and the inner surface 42 of the support portion 22 defines a hollow cylinder 46.

According to various embodiments, the crown portion 20 and the support portion 22 are fabricated from a rubber-like material such as PVC plastic. According to various embodiments, the crown portion 20 and the support portion 22 are integral.

Figure 4:
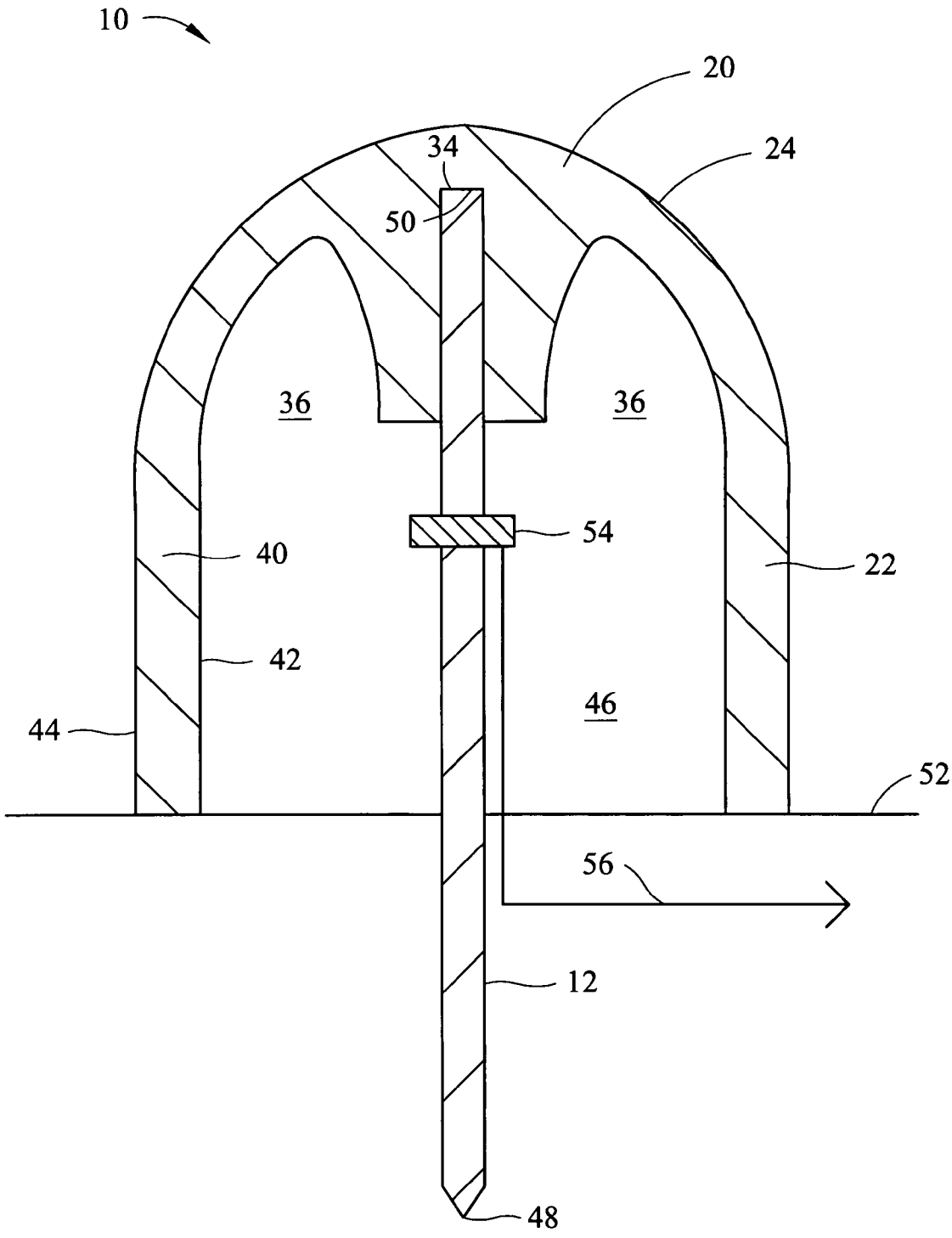
FIG. 4 illustrates a ground rod covered by the ground rod cap of FIG. 1.

FIG. 4 illustrates a ground rod 12 covered by the ground rod cap 10 of FIG. 1. The ground rod 12 includes a first end 48 and a second end 50 opposite the first end 48. As shown in FIG. 4, the first end 48 of the ground rod has been driven into the earth 52 and the second end 50 of the ground rod 12 is above the earth 52. The second end 50 of the ground rod 12 is positioned within the cavity 28 defined by the bottom surface 26 of the crown portion 20 such that the second end 50 of the ground rod 12 is proximate the closed end 34 of the cavity 28. A portion of the ground rod 12 positioned within the hollow cylinder 46 defined by the inner surface 42 of the curved wall 40 of the support portion 22 has a ground rod clamp 54 connected thereto, and the ground rod clamp 52 is connected to a ground wire 56. The ground wire 56 is connected to a device and/or system (not shown) as is known in the art. The bottom of the support portion 22 is in contact with the earth 52. For certain installations, the bottom of the support portion 22 is trimmed as needed to ensure that the second end 50 of the ground rod 12 is positioned within the cavity 28 defined by the bottom surface 26 of the crown portion 20 such that the second end 50 of the ground rod 12 is proximate the closed end 34 of the cavity 28.

When an object falls on the ground rod cap 10, the curved outer surface 24 of the crown portion 20 serves to naturally deflect the object's contact point away from the ground rod 12. Similarly, when an object falls on the ground rod cap 10, the void 36 encourages deformation of the crown portion 20, thereby deflecting the object's contact point away from the ground rod 12. Thus, the crown portion 20 serves to redirect the energy associated with a collision with the ground rod cap 10 away from the ground rod 12. In addition, when an object falls on the ground rod cap 10, the area of the crown portion 20 adjacent the closed end 34 of the cavity 28 serves to cushion the impact of any fall onto the ground rod cap 10.

While several embodiments of the disclosed invention have been described, it should be apparent, however, that various modifications, alterations and adaptations to those embodiments may occur to persons skilled in the art with the attainment of some or all of the advantages of the disclosed invention. For example, according to various embodiments, the bottom surface 26 of the crown portion 20 does not define a void 36 that encircles a portion of the cavity 28. It is therefore intended to cover all such modifications, alterations and adaptations without departing from the scope and spirit of the disclosed invention as defined by the appended claims.

What is claimed is:

1. A ground rod cap, comprising:

a crown portion, the crown portion comprising a cylindrical cavity for receiving a ground rod, the cylindrical cavity protruding from the crown portion and having a first end for receiving the ground rod and a second end for engaging an end of the ground rod; and a support portion connected to the crown portion, the support portion comprising a curved wall having an inner surface and an outer surface, wherein the inner surface defines a hollow cylinder that surrounds a ground rod clamp attaching a ground wire to a the ground rod, such that the location of the ground rod, ground rod clamp, and ground wire attachment is surrounded by a cylindrical void.

2. The cap of claim 1, wherein an outer surface of the crown portion is curved.

3. The cap of claim 2, wherein the outer surface of the crown portion defines a dome.

4. The cap of claim 1, wherein:

the ground rod cap defines a first axis; and the cylindrical cavity defines a second axis, wherein the second axis is coincident with the first axis.

5. The cap of claim 1, wherein the second end of the cavity is positioned away from the outer surface of the crown portion by a distance greater than or equal to a diameter associated with the cylindrical cavity.

6. The cap of claim 1, wherein the void is bounded by a curved surface.

7. The cap of claim 1, wherein:

the cap has a first maximum depth associated therewith; and the void has a second maximum depth associated therewith, wherein the first maximum depth is greater than the second maximum depth.

8. The cap of claim 1, wherein the curved wall is a continuously curving wall.

9. The cap of claim 1, wherein the curved wall has a uniform thickness.

10. The cap of claim 1, wherein the crown portion and the support portion are fabricated from a rubber-like material.

11. The cap of claim 10, wherein the rubber-like material is PVC plastic.

12. The cap of claim 1, wherein the crown portion and the support portion are integral.

13. A ground rod cap, comprising:

a closed end;

an open end opposite the closed end, an outer surface;

an inner surface; and a ground rod receptacle within the ground rod cap, the ground rod receptacle protruding from the closed end towards the open end of the ground rod cap, the ground rod receptacle comprising a central cavity within the ground rod receptacle to receive a ground rod, the central cavity having a first end for receiving the ground rod and a second end for engaging an end of the ground rod, the ground rod receptacle further defining curved side surfaces which are surrounded by a cylindrical void within the ground rod cap.

14. A ground rod cap, comprising:

a crown portion comprising:

a domed surface having a closed first end and an open second end;

a ground rod receptacle, the ground rod receptacle protruding from the closed first end towards the open second end, the ground rod receptacle comprising a central cavity within the ground rod receptacle to receive for receiving a ground rod, the central cavity having a first end for receiving the ground rod and a second end for engaging an end of the ground rod; and a support portion comprising a cylindrical wall, wherein the cylindrical wall is connected to the open second end of the domed surface to define a hollow cylindrical opening configured to cover a ground rod clamp for attaching a ground wire to the ground rod.

* * * * *